US006757653B2

(12) United States Patent
Buth et al.

(10) Patent No.: US 6,757,653 B2
(45) Date of Patent: Jun. 29, 2004

(54) REASSEMBLING SPEECH SENTENCE FRAGMENTS USING ASSOCIATED PHONETIC PROPERTY

(75) Inventors: Peter Buth, Bochum (DE); Simona Grothues, Bochum (DE); Amir Iman, Bochum (DE); Wolfgang Theimer, Bochum (DE)

(73) Assignee: Nokia Mobile Phones, Ltd., Espoo (FI)

( * ) Notice: Subject to any disclaimer, the term of this patent is extended or adjusted under 35 U.S.C. 154(b) by 520 days.

(21) Appl. No.: 09/894,961

(22) Filed: Jun. 28, 2001

(65) Prior Publication Data

US 2002/0029139 A1 Mar. 7, 2002

(30) Foreign Application Priority Data

Jun. 30, 2000 (DE) ..... 100 31 008

(51) Int. Cl.[7] ..... G10L 13/06; G10L 13/08
(52) U.S. Cl. ..... 704/258; 704/269; 704/266
(58) Field of Search ..... 704/258, 260, 704/259; 360/72.2

(56) References Cited

U.S. PATENT DOCUMENTS

| | | | | | |
|---|---|---|---|---|---|
| 3,797,037 | A | * | 3/1974 | Kolpek | 360/72.2 |
| 4,908,867 | A | * | 3/1990 | Silverman | 704/260 |
| 5,383,121 | A | | 1/1995 | Letkeman | 364/419.11 |
| 5,652,828 | A | * | 7/1997 | Silverman | 704/260 |
| 5,664,060 | A | | 9/1997 | Jarrett et al. | 704/270 |
| 5,832,434 | A | * | 11/1998 | Meredith | 704/260 |
| 5,913,194 | A | * | 6/1999 | Karaali et al. | 704/259 |
| 5,970,453 | A | * | 10/1999 | Sharman | 704/260 |
| 6,047,255 | A | | 4/2000 | Williamson | 704/212 |
| 6,212,501 | B1 | * | 4/2001 | Kaseno | 704/258 |
| 6,266,637 | B1 | * | 7/2001 | Donovan et al. | 704/258 |
| 2003/0028380 | A1 | * | 2/2003 | Freeland et al. | 704/260 |

FOREIGN PATENT DOCUMENTS

| | | | | | |
|---|---|---|---|---|---|
| DE | 3104551 | | | 8/1982 | |
| DE | 3104551 | A | * | 8/1982 | G10L/1/08 |
| DE | 3642929 | | | 6/1988 | |
| DE | 003642929 | A1 | * | 12/1988 | G10L/5/02 |
| DE | 19518504 | | | 5/1996 | |
| DE | 19518504 | A1 | * | 5/1996 | G10L/5/02 |
| JP | 04-077962 | | * | 3/1992 | G06F/15/38 |
| JP | 11-095796 | | * | 4/1999 | G10L/5/04 |

* cited by examiner

*Primary Examiner*—Richemond Dorvil
*Assistant Examiner*—Daniel A. Nolan
(74) *Attorney, Agent, or Firm*—Perman & Green, LLP

(57) ABSTRACT

A method of composing messages for speech output and the improvement of the quality of reproduction of speech outputs. A series of original sentences for messages is segmented and stored as audio files with search criteria. The length, position, and transition values for the respective segments can be recorded and stored. A sentence to be reproduced is transmitted in a format corresponding to the format of the search criteria. It is determined whether the sentence to be reproduced can be fully reproduced by one segment or a succession of stored segments. The segments found in each case are examined using their entries as to how far the individual segments match as regards speech rhythm. The audio files of the segments in which the examination resulted in the pre-requisites for optimal maintaining of the natural speech rhythm are combined and output for reproduction.

12 Claims, 5 Drawing Sheets

12

| Index | Search Criterion | Sentence | Audio File | Length | Position | Transition Values Front | Transition Values Rear |
|---|---|---|---|---|---|---|---|
| 1 | abbiegen | 3 | file 1 | 1 | 1 | s | — |
| 2 | abbiegen | 4 | file 2 | 1 | 0,5 | s | i |
| 3 | in 100 Metern | 1 | file 3 | 3 | 0 | — | l |
| 4 | in 100 Metern | 2 | file 4 | 3 | 1 | n | — |
| 5 | in 100 Metern | 3 | file 5 | 3 | 0 | — | l |
| 6 | in 100 Metern | 4 | file 6 | 3 | 1 | n | — |
| 7 | links | 4 | file 7 | 1 | 0 | — | a |
| 8 | links | 3 | file 8 | 1 | 0,5 | n | a |
| 9 | links abbiegen | 1 | file 9 | 2 | 1 | n | — |
| 10 | links abbiegen | 2 | file 10 | 2 | 0 | — | l |

11

10.1 10.3 10.2 10.4

| No. | Original Sentences | | |
|---|---|---|---|
| 1 | In 100 Metern | links abbiegen | |
| 2 | Links abbiegen | in 100 Metern | |
| 3 | In 100 Metern | links | abbiegen |
| 4 | Links | abbiegen | in 100 Metern |

Fig. 1

12

11

| Index | Search Criterion | Sentence | Audio File | Length | Position | Transition Values Front | Transition Values Rear |
|---|---|---|---|---|---|---|---|
| 1 | abbiegen | 3 | file 1 | 1 | 1 | s | — |
| 2 | abbiegen | 4 | file 2 | 1 | 0,5 | s | i |
| 3 | in 100 Metern | 1 | file 3 | 3 | 0 | — | l |
| 4 | in 100 Metern | 2 | file 4 | 3 | 1 | n | — |
| 5 | in 100 Metern | 3 | file 5 | 3 | 0 | — | l |
| 6 | in 100 Metern | 4 | file 6 | 3 | 1 | n | — |
| 7 | links | 4 | file 7 | 1 | 0 | — | a |
| 8 | links | 3 | file 8 | 1 | 0,5 | n | a |
| 9 | links abbiegen | 1 | file 9 | 2 | 1 | n | — |
| 10 | links abbiegen | 2 | file 10 | 2 | 0 | — | l |

Fig. 2

| Serial No. | Combinations | Text |
|---|---|---|
| 1 | 3,9 | in 100 Metern + links abbiegen |
| 2 | 3,10 | in 100 Metern + links abbiegen |
| 3 | 4,9 | in 100 Metern + links abbiegen |
| 4 | 4,10 | in 100 Metern + links abbiegen |
| 5 | 5,9 | in 100 Metern + links abbiegen |
| 6 | 5,10 | in 100 Metern + links abbiegen |
| 7 | 6,9 | in 100 Metern + links abbiegen |
| 8 | 6,10 | in 100 Metern + links abbiegen |
| 9 | 3,7,1 | in 100 Metern + links + abbiegen |
| 10 | 3,7,2 | in 100 Metern + links + abbiegen |
| 11 | 3,8,1 | in 100 Metern + links + abbiegen |
| 12 | 3,8,2 | in 100 Metern + links + abbiegen |
| 13 | 4,7,1 | in 100 Metern + links + abbiegen |
| 14 | 4,7,2 | in 100 Metern + links + abbiegen |
| 15 | 4,8,1 | in 100 Metern + links + abbiegen |
| 16 | 4,8,2 | in 100 Metern + links + abbiegen |
| 17 | 5,7,1 | in 100 Metern + links + abbiegen |
| 18 | 5,7,2 | in 100 Metern + links + abbiegen |
| 19 | 5,8,1 | in 100 Metern + links + abbiegen |
| 20 | 5,8,2 | in 100 Metern + links + abbiegen |
| 21 | 6,7,1 | in 100 Metern + links + abbiegen |
| 22 | 6,7,2 | in 100 Metern + links + abbiegen |
| 23 | 6,8,1 | in 100 Metern + links + abbiegen |
| 24 | 6,8,2 | in 100 Metern + links + abbiegen |

Fig. 3

| Serial No. | Combinations | | Length | Position W | Front W | Rear W |
|---|---|---|---|---|---|---|
| 1 | 3 | in 100 Metern | 3 | 0 | — | I |
| | 9 | links abbiegen | 2 | 1 | n | — |
| 2 | 3 | in 100 Metern | 3 | 0 | — | I |
| | 10 | links abbiegen | 2 | 1 | n | — |
| 3 | 4 | in 100 Metern | 3 | 0 | — | I |
| | 9 | links abbiegen | 2 | 1 | n | — |
| 4 | 4 | in 100 Metern | 3 | 0 | — | I |
| | 10 | links abbiegen | 2 | 1 | n | — |
| 5 | 5 | in 100 Metern | 3 | 0 | — | I |
| | 9 | links abbiegen | 2 | 1 | n | — |
| 6 | 5 | in 100 Metern | 3 | 0 | — | I |
| | 10 | links abbiegen | 2 | 1 | n | — |
| 7 | 6 | in 100 Metern | 3 | 0 | — | I |
| | 9 | links abbiegen | 2 | 1 | n | — |
| 8 | 6 | in 100 Metern | 3 | 0 | — | I |
| | 10 | links abbiegen | 2 | 1 | n | — |

Fig.4

| Serial No. | Combinations | | Length | Result I | Position W | Position A | Result II | Front W | Front A | WÜ (Front) | Result III | Rear W | Rear A | WÜ (Rear) | Result IV | Sum | B |
|---|---|---|---|---|---|---|---|---|---|---|---|---|---|---|---|---|---|
| 1 | 3 | in 100 Metern | 3 | **0,3** | 0 | 0 | **0** | — | — | 0,5 | **0** | I | I | 0,5 | **0** | 0,3 | **0,8** |
| | 9 | links abbiegen | 2 | **0,5** | 1 | 1 | **0** | n | n | 0,5 | **0** | — | — | 0,5 | **0** | 0,5 | |
| 2 | 3 | in 100 Metern | 3 | **0,3** | 0 | 0 | **0** | – | – | 0,5 | **0** | I | I | 0,5 | **0** | 0,3 | **2,8** |
| | 10 | links abbiegen | 2 | **0,5** | 1 | 0 | **1** | n | — | 0,5 | **0,5** | — | I | 0,5 | **0,5** | 2,5 | |
| 3 | 4 | in 100 Metern | 3 | **0,3** | 0 | 1 | **1** | — | n | 0,5 | **0,5** | I | — | 0,5 | **0,5** | 2,3 | **2,8** |
| | 9 | links abbiegen | 2 | **0,5** | 1 | 1 | **0** | n | n | 0,5 | **0** | — | — | 0,5 | **0** | 0,5 | |
| 4 | 4 | in 100 Metern | 3 | **0,3** | 0 | 1 | **1** | — | n | 0,5 | **0,5** | I | — | 0,5 | **0,5** | 2,3 | **4,8** |
| | 10 | links abbiegen | 2 | **0,5** | 1 | 0 | **1** | n | — | 0,5 | **0,5** | — | I | 0,5 | **0,5** | 2,5 | |
| 5 | 5 | in 100 Metern | 3 | **0,3** | 0 | 0 | **0** | – | — | 0,5 | **0** | I | I | 0,5 | **0** | 0,3 | **0,8** |
| | 9 | links abbiegen | 2 | **0,5** | 1 | 1 | **0** | n | n | 0,5 | **0** | — | — | 0,5 | **0** | 0,5 | |
| 6 | 5 | in 100 Metern | 3 | **0,3** | 0 | 0 | **0** | — | — | 0,5 | **0** | I | I | 0,5 | **0** | 0,3 | **2,8** |
| | 10 | links abbiegen | 2 | **0,5** | 1 | 0 | **1** | n | — | 0,5 | **0,5** | — | I | 0,5 | **0,5** | 2,5 | |
| 7 | 6 | in 100 Metern | 3 | **0,3** | 0 | 1 | **1** | — | n | 0,5 | **0,5** | I | — | 0,5 | **0,5** | 2,3 | **2,8** |
| | 9 | links abbiegen | 2 | **0,5** | 1 | 1 | **0** | n | n | 0,5 | **0** | — | — | 0,5 | **0** | 0,5 | |
| 8 | 6 | in 100 Metern | 3 | **0,3** | 0 | 1 | **1** | – | n | 0,5 | **0,5** | I | — | 0,5 | **0,5** | 2,3 | **4,8** |
| | 10 | links abbiegen | 2 | **0,5** | 1 | 0 | **1** | n | — | 0,5 | **0,5** | — | I | 0,5 | **0,5** | 2,5 | |

Fig. 5

REASSEMBLING SPEECH SENTENCE FRAGMENTS USING ASSOCIATED PHONETIC PROPERTY

DESCRIPTION

1. Technical Field

The invention concerns a method of composing messages for speech output, in particular the improvement of the quality of reproduction of speech outputs of this kind.

2. Prior Art

In the prior art systems are known in which corresponding entries are called from a database to implement speech outputs. In detail this can be executed in such a way that, for example, a specific number of different messages, in other words, e.g., of different sentences, commands, user requests, figures of speech, phrases or similar, are filed in a memory and according to requirement for a filed message this is read out from the memory and reproduced. It is easy to see that arrangements of this kind are very inflexible, as only messages which have been fully stored beforehand can be reproduced.

Therefore there has been a changeover to dividing up messages into segments and storing them as corresponding audio files. If a message is to be output it is necessary to reconstruct the desired message from the segments. In the prior art this is done in such a way that for the message to be formed only corresponding instructions are transferred to the segments in the relevant order for the message. By means of these instructions the corresponding audio files are read out from the memory and united for output. This method of forming sentences or parts of sentences is characterised by a great flexibility with only a low memory requirement. It is, however, felt to be disadvantageous that reproduction compiled by this method sounds very synthetic as no account is taken of the natural flow of speech.

SUMMARY OF THE INVENTION

The object of the invention is to disclose a method of forming messages from segments, which takes account of the natural flow of speech and thus results in harmonious reproduction results.

By composing messages for speech output the messages composed of segments of at least one original sentence, which are stored as audio files. A message intended for output is composed from the segments stored as audio files and selected using search criteria from the stored audio files. Each segment is allocated at least one parameter characterizing its phonetic properties in the original sentence. Using the parameters of the individual segments characterizing the phonetic properties in the original sentence, a check is made as to whether the segments forming the reproduction sentence to be output as a message are composed according to their natural flow of speech.

According to the invention, therefore, with a method for composing messages for speech output from segments of at least one original sentence, which are stored as audio files, in which a message intended for output is composed from the segments stored as audio files, which segments are selected from the stored audio files using search criteria, it is provided that every segment is allocated at least one parameter characterising its phonetic properties in the original sentence and that using the parameters characterising the phonetic properties in the original sentence of the individual segments a check is made as to whether the segments forming the reproduction sentence to be output as a message are composed according to their natural flow of speech. In this way it can be achieved that in reproducing speech the natural flow and rhythm of speech of a message is largely reconstructed without the message itself having to be fully stored.

To obtain an even more natural message it is advantageous if every segment is allocated several parameters characterising its phonetic properties in the original sentence, wherein the parameters can advantageously be selected from the following parameters: length of the respective segment, position of the respective segment in the original sentence, front and/or rear transition value of the respective segment to the preceding or following segment in the original sentence, wherein the length of the search criterion allocated in each case is further used as the length of the respective segment.

To achieve particularly good results, in an advantageous further development of the invention it is provided that as transition values the last or the first letters, syllables or phonemes of the preceding or following segment in the original sentence are used. A particularly high-quality reproduction of reproduction sentences composed from audio files is achieved if phonemes are used as transition values.

As the sentence melody largely depends on the type of sentence, a further improvement in reproduction is achieved, if as a further parameter data are provided on whether the respective segment of the original sentence is derived from a question or exclamation sentence.

An advantageous further development of the invention is characterised in that for a found combination of segments forming the reproduction sentence to be output as a message an evaluation measurement is calculated from the parameters of the individual segments characterising the phonetic properties in the original sentence according to the following formula:

$$B = \sum_{n,l} W_n f_{n,i}(n) *$$

wherein $f_{n,i}(n)$is a functional correlation of the nth parameter, i is an index designating the segment and $W_n$ is a weighting factor for the functional correlation of the nth parameter. The parameter itself, its reciprocal value or a consistency value of the parameter allocated to the stored segment with the parameter which would be allocated to the segment in the combination for the message can, for example be provided as the functional correlation of a parameter. The weighting factors therein enable a very slight displacement of the preferences in determining the evaluation measurement.

According to the evaluation measurements from the found combinations of segments those whose evaluation measurement indicates that the segments of the combination are composed according to a natural flow of speech are selected as the message to be output.

In another configuration of the invention it is provided that the evaluation measurement B is calculated from the functional correlations $f_n(n)$ of at least the following parameters, length L and position P, as well as the front and rear transition value $\ddot{U}_{vorn}$, $\ddot{U}_{hinten}$ of the segment, according to the following formula:

$$B = \sum_i \{W_L f_{Li}(L) + W_P f_{Pi}(P) + W_{\ddot{U}} f_{\ddot{U}i}(\ddot{U}_{vorn}) + W_{\ddot{U}} f_{\ddot{U}i}(\ddot{U}_{hinten})\}.$$

The evaluation is particularly simple if the reproduction sentence is in a format corresponding to the search criteria, wherein preferably alphanumeric character strings are used for the search criteria and the transmitted reproduction sentences.

In order to achieve a quick search in a database it is advantageous if the search criteria are hierarchically arranged in a database.

Selection of segments for the reproduction of a message is particularly easy if for selecting the segments for a message stored as audio files a test is done as to whether the reproduction sentence desired as a message coincides in its entirety with a search criterion filed in a database together with an allocated audio file, wherein, if this is not the case, the end of the respective reproduction sentence is reduced and then checked for consistencies with the search criteria filed in the database until one or more consistencies have been found for the remaining part of the reproduction sentence, if for those parts of the reproduction sentence which were detached in a preceding step the checking mentioned in the last passage is continued, if for every combination of segments whose search criteria fully coincide with the reproduction sentence a check is done as to whether the segments forming the reproduction sentence to be output as a message are composed according to their natural flow of speech and if for the reproduction of a desired message the audio files of the segments whose combination comes closest to the natural flow of speech are used.

Therefore once it is ensured that for every segment at least one data record with a search criterion, an audio file and at least one parameter characterizing its phonetic properties in the original sentence, in other words additional information on the respective segment, is filed, a combination of segments can very easily be compiled using the data records edited in this way, the reproduction of which is no longer distinguishable from a spoken reproduction of the corresponding message. This effect is achieved in that before output of a message, in other words before the reproduction of sentences, parts of sentences, requests, commands, phrases or similar, a search is done inside the database for segments from which corresponding combinations for the desired message can be formed and in that using the information on every segment used an evaluation is carried out on every found combination consisting of one or more segments, describing the approximation of the combination to the natural flow of speech. Once the evaluations for the compiled combinations are complete the combination of segments which comes closest to the natural flow of speech is selected for the message.

BRIEF DESCRIPTION OF THE FIGURES

The invention is explained below in greater detail as an example using embodiment examples with reference to the attached drawings.

FIG. 1 shows a list of four original sentences.

FIG. 2 shows a table illustrating a database with 10 data records.

FIG. 3 shows a table with combinations consisting of segments fully reproducing the reproduction sentence.

FIG. 4 shows a table showing data records for a segmented reproduction sentence.

FIG. 5 shows a table showing the overall evaluation.

WAYS OF EXECUTING THE INVENTION

In FIG. 1 is shown a list of four original sentences which can be reproduced as required as messages by means of a speech output device, wherein each of these original sentences is divided by a vertical line into two or more segments 10. Although each of these four original sentences has the same meaning content and—if you ignore the order—no differences in the letters and numbers used emerge, considerable differences are evident between the individual original sentences if they are reproduced acoustically. This is due to the fact that depending on the placing of individual words or word groups in the sentence structure different intonations can emerge. If, for example, the sentence "In 100 Metern links abbiegen" ("In 100 meters turn left") is to be reproduced as a message and if for reproducing it segments 10.4 and 10.3 are used rather than segments 10.1 and 10.2, this does not results in a harmonious reproduction corresponding to the normal flow of speech.

If one wants to retain the intonation specific to the sentence of the four original sentences illustrated in the list (FIG. 1) without knowledge of the invention it is necessary to file each of these original sentences in its entirety as an audio file. It is easy to see that this results in a considerable memory requirement.

To avoid extending the memory requirement, but at the same time to ensure that harmonious reproduction results corresponding to the normal flow of speech are produced, it is necessary to analyse a series of sentences in their originally spoken form. An analysis of this kind is now carried out below as an example using the original sentences shown in FIG. 1.

Firstly the different sentences for a message are spoken and recorded by a speaker as so-called original sentences.

Then the original sentences recorded in this way are divided into segments 10, wherein each of these segments 10 is filed in an audio file.

Additionally a group of search criteria is allocated to each original sentence. This group of search criteria is divided up according to the segmentation of the original sentences, wherein one search criterion is allocated to each segment 10. The mutual allocation of audio files and search criteria takes place in a database 11, shown in greater detail in FIG. 2. As can be seen from this database 11 in the present example alphanumeric character strings are used as search criteria, wherein the character strings used as search criteria correspond to the textual reproduction of the allocated segments 10 filed as audio files. For the sake of completeness it should be pointed out that neither the previously mentioned character strings nor alphanumeric characters have to be used as search criteria as long as it is ensured that the characters or series of characters used as search criteria identically characterise any segments 10 whose textual content is identical. For example it is conceivable to allocate a segment identification number to each segment.

As can further be seen from the illustration in FIG. 2 the database 11 has further entries 12. According to the column headings these entries 12 are the length (L) of the respective segment, its position P within the sentence and two connecting sounds or transition values ($\ddot{U}_{vorn}$, $\ddot{U}_{hinten}$).

The way these entries 12 are acquired is now explained below:

Once the original sentences are segmented, the respective entries 12 relating to the length (L) are acquired, e.g., by calculating the number of words of the allocated segment 10 for each of the search criteria. In the present embodiment example the words within the allocated search criteria can be enlisted for this. This results in a length value of 1 for the audio file or the segment 10 allocated to the search criterion "abbiegen" ("turn"), while the search criterion "in 100 Metern" ("in 100 meters") is allocated the length value 3, as the sequence of numbers "100" is regarded as a word. For the sake of completeness it should be pointed out that the words contained in the search criterion do not necessarily have to be enlisted to acquire the length information. Instead, in another embodiment example—not further illustrated—the number of characters contained in the respective search criterion can be used. This would, for example, for the search criterion "abbiegen" result in a length value of 8 and for the search criterion "in 100 Metern" to a length value of 13, as with the latter search criterion the blank strokes between the words as well as the numbers are evaluated as characters. It is further conceivable to use the number of syllables or phonemes as the length value.

The entry 12 reproducing the position (P), is acquired, for example, by initially calculating the number of segments 10 or search criteria per original sentence. If, for example, it emerges that when an original sentence is segmented it is divided into three segments 10, the first segment 10 is assigned the position value 0, the second segment 10 the position value 0.5 and the last of the three segments 10 the position value 1. If, however, the original sentence is divided into only two segments 10 (as in the first two original sentences in FIG. 1) the first segment 10 is given the position value 0, while the second and last segment 10 is given the position value 1. If the original sentence consists of four segments 10 the first segment 10 has the position value 0, the second segment 10 the position value 0.33 and the third segment 10 the position value 0.66, while the last segment again is given the position value 1.

It is further possible instead of the actual position in a sentence only to indicate whether the respective segment 10 is at the beginning or end of a message or between two segments 10.

By transition values (Ü) in the sense of this application are understood the relations of a segment 10 or search criterion to the segment 10 preceding and following this segment 10 or search criterion. This relation for the respective segment 10 is in the present example produced to the last letter of the previous segment 10 and to the first letter of the following segment 10. A more precise explanation will now be carried out using the first original sentence (In 100 Metern links abbiegen) according to FIG. 1. As the first segment 10 or search criterion of this original sentence (In 100 Metern) has no preceding segment 10 or search criterion, in the database relating to this segment 10 and bearing the index number 3 (FIG. 2) the entry "blank" indicated as "-" in the drawings is noted as front transition value. As the segment 10 (In 100 Metern) is followed in the original sentence by the segment 10 (links abbiegen), because in the present embodiment example only one letter is used as transition values (Ü), an "I" is noted as the rear transition value (Ü) in the database with the index number 3. The procedure is the same for the second segment (10) of the original sentence (links abbiegen) which in the database with the index number 9 results in the front transition value (Ü) "n" and to the rear transition value (Ü) "blank", as the segment 10 (in 100 Metern) preceding the segment 10 (links abbiegen) in the original sentence, ends with an "n" and no further segment 10 follows the segment 10 (links abbiegen) in the original sentence.

The limitation, shown in the previous paragraph, of the transition values (Ü) for the respective segment 10 to the last letter of the segment 10 preceding this segment 10 or the first letter of the segment 10 following this segment 10 is not compulsory. It is equally possible for letter groups or phonemes of the segments 10 preceding and following the respectively observed segment 10 to be used instead of individual letters as respective transition values (Ü). Therein in particular the use of phonemes results in high quality reproduction of messages composed from audio files using the data records according to FIG. 2.

It should further be pointed out that the entries 12 shown in FIG. 2 do not have to be limited to the length, the position and the two transition values. It is equally possible for further entries 12—not shown—to be provided to improve further the quality of the messages. As there is a difference in intonation between question and exclamation sentences, although the textual reproduction of the corresponding sentence, without taking account of punctuation marks, is identical, a column can be provided as a further entry 12 in the database 11 according to FIG. 2, in which is noted whether the respective segment 10 or search criterion is derived from a question or exclamation sentence. The latter can, for example, be organised in such a way that a "0" is allocated, if the respective segment 10 is derived from an original sentence which raises a question and a "1" is entered if the segment 10 has been taken from an original sentence which has an exclamation as its subject. In addition to the entry of question and exclamation sentences in another embodiment example—not explained in greater detail—further punctuation marks can be recorded as entries 12 in the database 11 according to FIG. 2, which are suitable for bringing about intonation differences.

Once all the original sentences have been segmented in the preceding way and the resulting segments 10 have been analysed, this results in a database 11 shown in FIG. 2 for the four original sentences according to FIG. 1. It can clearly be seen from this database 11 that the different data records are sorted alphabetically in ascending order using search criteria.

The reconstruction of the original sentence "In 100 Metern links abbiegen" presented in the list according to FIG. 1 will be illustrated below using the data records from the database 11.

For this purpose the entire sentence "In 100 Metern links abbiegen" intended for reproduction is put into a format in which the search criteria of the corresponding segments 10 are present. As in the embodiment example illustrated the search criteria correspond to the textual reproduction of the audio file, the sentence to be reproduced is also put into this format, insofar as it was not already in this format. Then a test is done as to whether one or more search criteria having complete consistency with the correspondingly formatted sentence intended for reproduction "In 100 Metern links abbiegen" are present in the database 11. As, according to the database shown in FIG. 2, this is not the case, the search string of the sentence intended for reproduction (In 100 Metern links abbiegen) is shortened by the last word "abbiegen" and examined as to whether this partial sentence "In 100 Metern links" appears in this form in the database 11 as a search criterion. As this comparison is also bound to turn out negative owing to the content of the database 11, there is repeated reduction of the sentence intended for reproduction by one word. Then another test is done as to whether the part of the sentence reduced in this way "In 100 Metern" appears in the data records of the database 11 as a search criterion. According to the contents of the database 11 this can be affirmed for the data records with the indices 3 to 6. This then results in intermediate storage of the found indices 3 to 6.

The parts of the sentence which were removed in the previous steps are then joined together again in their original order "links abbiegen" and examined as to whether there is at least one correspondence in the search criteria of the database 11 for this sentence component. In this comparison the data records with the indices 9 and 10 are recognised as data records in which the search criteria fully coincide with the partial sentence "links abbiegen". These indices 9 and 10 are also intermediately stored. This brings the search task to an end, as the search string can be fully reproduced by search criteria in the database 11.

Then from the indices found in each case combinations are formed which in each case yield the sentence to be reproduced. The latter is shown in greater detail in FIG. 3. As in the present example the sentence to be reproduced is formed from both the indices 9 and 10 and the indices 3 to 6, only the combinations in FIG. 3 with the serial numbers 1 to 8 are of relevance. The remaining combinations in FIG. 3 are of no significance in this embodiment example.

For the sake of completeness it should be pointed out that in FIG. 3 the column contents of the column "Text" serve only as illustration and are not filed with the combinations.

When the search task has ended the length and position data and data on the transition values of the sentence to be reproduced according to convention, which were decisive in determining the corresponding entries 12 in the database 11, are determined in that the length and position data as well as the respective transition values are intermediately stored for the sentence parts whose index is in the relevant combination. Intermediate storage of this kind is shown in FIG. 4 for the sentence to be reproduced "In 100 Metern links abbiegen", wherein the designation W indicates that this concerns the position and the transition values of the segments in the sentence to be reproduced and not the values stored in the database 11. For the length data it is possible to go back to the values entered in the data records with the indices 3 to 6 or 9 and 10, as owing to the circumstance that if the sentence to be reproduced or a part of it has found full correspondence in the search criteria according to FIG. 2, the length datum in the corresponding data records of the database 11 according to FIG. 2 coincides with the length value of the part of the sentence to be reproduced.

Once the combinations according to the serial numbers 1 to 8 in FIG. 3 have been formed, an evaluation of the combinations is carried out, in that for each of these combinations an evaluation measurement B is determined with the aid of the entries 12 for the segments 10 or search criteria in the database 11, which are involved in the respective combination. Calculation of the evaluation measurement B is done according to the following formula:

$$B = \sum_{n,I} W_n f_{n,i}(n)$$

wherein $W_n$ is a weighting factor for the nth entry 12, $f_{n,i}$ is a functional correlation of the nth entry 12, n is a serial index running over the individual entries of a data record allocated to a segment involved in a combination and i is a further serial index running over all indices of the data records or segments involved in the combination.

It is easy to see that a functional correlation $f_{n,i}(n)$ is therefore calculated for every entry n recorded in the formula. In order to produce a weighting of the different functional correlations put into the formula, some or even all the functional correlations can be provided with a weighting factor $W_n$.

If, for example, for the length information L of a segment 10 the functional correlation $f_{Li}(L)$ is formed in such a way that the value one is divided by the value of the length L corresponding to the entry (length) in the respective data record i, in each case a value is obtained which is smaller than one for every data record whose index is involved in a combination, insofar—as assumed here—as the weighting factor $W_L$ for the length is equal to one. It is easy to see that longer segments 10 produce conditional upon the formula smaller values $f_{Li}(L)$. These smaller values are preferably to be aimed at because owing to the longer segments an already existing sentence melody can be better utilised.

In order to produce a functional correlation $f_{pi}(P)$ for the position information P this can, for example, be constructed in such a way that the intermediately stored position values $P_W$ from FIG. 4 are related to the position values $P_A$ of the corresponding data records in the database in such a way that if the position values coincide the value zero is allocated (if $P_W=P_A$ then $f_{pi}(P)=0$) and if they do not coincide the value one, for example, (if $P_W \neq P_A$) then $f_{pi}(P)=1$) is output, if the weighting factor $W_P$ is one. Other values than one can be set via the weighting factor $W_P$.

The functional correlation for the transition values ($f_{\ddot{U}}$,i($\ddot{U}_{vorn}$), ($f_{\ddot{U}}$i($\ddot{U}_{hinten}$) can be formed analogously to the preceding paragraph, in that the intermediately stored transition values $\ddot{U}_{vorn,W}$, $\ddot{U}_{hinten,\ W}$ from FIG. 4 are related to the transition values $\ddot{U}_{vorn,D}$, $\ddot{U}_{hinten,D}$ of the corresponding data records from the database in such a way that if they coincide a zero and if they do not coincide a value larger than zero is allocated. Here too an corresponding weighting factor $W_{\ddot{U}}$ can again be used. In order to produce an equal weighting of the transition values Ü with the remaining factors, the functional correlations for the front and rear transition value should advantageously in each case be provided with a weighting factor Ü of 0.5. For the described embodiment example the following formula thus emerges:

$$B = \sum_i \left\{ W_L f_{Li}(L) + W_P f_{Pi}(P) + W_{\ddot{U}} f_{\ddot{U}i}(\ddot{U}_{vorn}) + W_{\ddot{U}} f_{\ddot{U}i}(\ddot{U}_{hinten}) \right\}$$

In FIG. 5 a table is shown which illustrates in greater detail the calculation of the evaluation measurement B for each of the eight found combinations using the above formula. In this table the column headings have the following meaning:

- Serial no. corresponds to the serial number of the combinations according to FIG. 3
- Combinations corresponds to the combinations according to FIG. 3
- Length corresponds to the length L of the search criterion according to FIG. 2
- Result I corresponds to the functional correlation $f_L(L)$= 1/length
- Position W corresponds to position values P which are intermediately stored for the sentence to be reproduced and shown in FIG. 4
- Position A corresponds to the position entries P related to the data records in the database 11 according to FIG. 2
- Result II shows the result of the functional correlation $f_{p,i}(P)$ between position W and Position A.
- Front W corresponds to the front transition values shown in FIG. 4 which are intermediately stored for the sentence to be reproduced
- Front A corresponds to the front transition values related to the data records in the database 11 according to FIG. 2
- WÜ(front) shows the weighting factor $W_{\ddot{u}}$ for the front transition value Result III shows the result of the functional correlation $f_{\ddot{U}},i(\ddot{U}_{vorn})$ between front W and front A taking into account the weighting factor $W_{\ddot{u}}$ Rear W corresponds to the rear transition values shown in FIG. 4 which are intermediately stored for the sentence to be reproduced Rear A corresponds to the rear transition values related to the data records in the database 11 according to FIG. 2

WÜ (rear) shows the weighting factor $W_{\ddot{u}}$ for the rear transition value Result IV shows the result of the functional correlation $f_{\ddot{U}},i(\ddot{U}_{hinten})$ between rear W and rear A taking into account the weighting factor $W_{\ddot{u}}$ Sum Addition of the results I to IV B Addition of the sums per serial number It can clearly be seen from the table according to FIG. 5 that for each serial number B values emerge which are between 0.8 and 4.8. In addition it can be seen from the table according to FIG. 5 that double B values are also present. As preferably only those audio files whose combinations according to FIG. 3 after evaluation according to the above formula have the lowest B value of all the combinations should be combined from data records of the database 11 for speech reproduction, all occurring B values which according to the table according to FIG. 5 are greater than 0.8 are insignificant. This insignificance does not, however, prevail in the combinations of the serial numbers 1 and 5 according to FIG. 5, as in these combinations the B values are around 0.8 and thus represent the smallest B values. In addition the data records 3 and 5 used to form the combinations according to the serial numbers 1 and 5 (according to FIG. 2) are equal. A situation of this kind hardly ever occurs in practice, however, as the database according to FIG. 2 is optimised before its final completion. This optimisation is carried out in such a way that after the database has been compiled the data records of the individual segments are compared to establish whether data records are present which coincide in all entries, which in other words in the embodiment example described have the same search criteria, length data, position data and transition values. If this can be established the duplicated data records are deleted. Therefore there is no associated loss in quality as the duplicated data records are identical in respect of their evaluation.

Once this optimisation step has been carried out the data records with the indices 3 and 5 are characterised as duplicated and according to a further convention only the data record having the smallest index number is left in the database. As a result of deleting the data record with the index 5, in FIG. 4 no combinations further appear having the serial numbers 5 and 6. Consequently the serial numbers 5 and 6 also disappear from the table according to FIG. 5, so no B values are calculated for these combinations and the combination 3/9 (serial number 1) is established as the combination with the smallest B value.

But even when, after the optimisation steps and the evaluation of combinations have been carried out, equal B values are calculated, problems can be prevented in that by means of a stipulation it is specified that, for example, in such a case only the combination which was first found is used.

Once it is established after the evaluation has been carried out which combination has the lowest B value the corresponding audio files are composed and output using the indices involved. If it has emerged that in the previously mentioned embodiment example the combination 3/9 is the combination with the smallest B value the corresponding audio files (file 3 and file 9) are combined and output.

For the sake of completeness it should be pointed out that the audio files do not necessarily have to be stored in the database 11 according to FIG. 2. It is equally sufficient if corresponding references to the audio files filed at another site are present in the database 11.

Another kind of search will now be explained below.

The starting point for this example is also the reproduction sentence "In 100 Metern links abbiegen" (In 100 meters turn left). If this sentence is received as a text string a test is first done as to whether at least the beginning of this sentence coincides with a search criterion in the table according to FIG. 2. In this test the table according to FIG. 2 begins from the end, i.e. beginning with the last entry. In the present case this would be the data record with the index 10. During this test the entry "in 100 Metern" is found, which has the index 6. As the found entry "in 100 Metern" cannot completely cover the reproduction sentence, the part not covered by the search criterion of the data record just found is removed. In addition the data record with index 6 is intermediately stored.

Then a test is carried out as to whether at least a partial correspondence for the removed part of the reproduction sentence "links abbiegen" is present in the search criteria according to the table in FIG. 2. In this search too the table according to FIG. 2 is searched from the bottom to the top. In this search—as is easy to see—the entry "links abbiegen", which has the index 10, is found at once. The data record with index 10 just found is then copied and intermediately stored together with the data record with index 6. As already explained above, the found part of the sentence is then removed from the search string and, if applicable, the search is started again. As now, however, the removed part no longer has any content this means that the combination of search criteria with the indices 6 and 10 is a combination which fully comprises the sentence to be reproduced.

If this situation occurs the search for the part of the reproduction sentence "links abbiegen" is continued, wherein it does not start at the end of the table according to FIG. 2, but after the point at which the last correspondence (here data record with the index 10) was found. This results in the entry with the index 9 being found. After the data record with index 9 has been found here too the [data record] with index 6 is copied and intermediately stored together with the found data record with index 9 as a possible intermediate solution. The found part "links abbiegen" is then removed from the search string and the search for the rest is begun. As, on removal of the part "links abbiegen", the search string no longer has any content the index combination 6, 9 is noted as a combination which fully covers the sentence to be reproduced.

This compete coverage results in the search for the part of the reproduction sentence "links abbiegen" continuing, wherein here too it does not begin at the end of the table according to FIG. 2, but after the point at which the last entry (here the data record with the index 9) was found. This results in the entry "links" with the index 8 being found, because during the search what is always being looked for is whether the beginning of the respective search string is contained in the search criteria.

The data records with index 6 and index 8 are then intermediately stored as a possible partial solution.

Subsequently removal of the found part "links" and a further search for the part "abbiegen" remaining in the search string takes place again. This search then results in the entry with the index 2 being found. Then the combination 6, 8 intermediately stored in the last step as a partial solution is again copied and intermediately stored together with the data record with index 2 as a further partial solution. Once more the found part is removed from the search string. As the search string is empty once again the combination of the data records with the indices 6, 8, 2 is stored as a combination which fully reproduces the reproduction sentence. Then the preceding step is returned to and the search for a correspondence of the search string "abbiegen" is continued, wherein here too the search for the entry is begun where the last correspondence (here the data record with the index 2) was found. Herein the data record with the index 1 is found, which results in the result that the combination of the data records with the indices 6, 8, 1 is stored as a combination which fully reproduces the reproduction sentence.

Then the search for a correspondence of the search string "links abbiegen" is continued, wherein here too the search for the entry is begun where the last correspondence (here the data record with the index 8) was found. This results in a corresponding application of the basic principles described in the finding of the following index combinations 6/7/2 and 6/7/1.

After combination 6/7/1 has been found the search is continued with the search string "In 100 Metern links abbiegen", wherein this search starts after the last found index 6. If the whole reproduction sentence is analysed according to the preceding basic principles all the combinations shown in FIG. 3 under the serial numbers 1 to 28 are found. This results—as is easy to see—in a corresponding extension of the table according to FIG. 5.

In order to limit the necessary search and computational steps it is advantageously provided that if the reproduction is to be fully analysed according to the preceding basic principles this analysis is interrupted if, for example, B values are determined which are smaller than or equal to a predetermined value, e.g. 0.9. This does not result in loss of quality, because during the search for correspondences of the respective search string long search criteria are always found first in the database 11.

It can further be provided that the search for combinations is interrupted if a certain predeterminable number of combinations, for example 10 combinations, has been found. It is easy to see that by this measure the memory requirement and the necessary computer power is reduced. This limit on combinations is particularly advantageous if the search is carried out according to the last mentioned method. This is due to the fact that with this search method longer segments are always found first. This finding of the longer segments offers a guarantee that the best combination is usually recognised among the first combinations and thus no loss of quality occurs.

What is claimed is:

1. A method of composing messages for speech output consisting of segments (10) of at least one original sentence, which are stored as audio files, in which a message intended for output is composed from the segments (10) stored as audio files, selected using search criteria from the stored audio files, characterised in that each segment (10) is allocated at least one parameter (12) characterising its phonetic properties in the original sentence and using the parameters (12) of the individual segments (10) characterising the phonetic properties in the original sentence a check is made as to whether the segments (10) forming the reproduction sentence to be output as a message are composed according to their natural flow of speech.

2. The method according to claim 1, characterised in that each segment (10) is allocated several parameters (12) characterising its phonetic properties in the original sentence.

3. The method according to claim 1, characterised in that as the parameters (12) characterising the phonetic properties of the segments (10) in the respective original sentence at least one of the following parameters is used:

length (L) of the respective segment (10)

position (P) of the respective segment (10) in the original sentence front and/or rear transition value (Ü) of the respective segment (10) to the preceding or following segment (10) in the original sentence.

4. The method according to claim 3, characterised in that the length of the search criterion allocated in each case is used as the length (L) of the respective segment.

5. The method according to claim 3, characterised in that the last or first letters, syllables or phonemes of the preceding or following segment (10) in the original sentence are used as transition values (Ü).

6. The method according to claim 1, characterised in that as a further parameter (12) data are provided on whether the respective segment (10) of the original sentence is derived from a question or exclamation sentence.

7. The method according to claim 1, characterised in that for a found combination of segments (10) forming the reproduction sentence to be output as a message, an evaluation measurement (B) is calculated from the parameters (12) of the individual segments (10) characterising the phonetic properties in the original sentence according to the following formula:

$$B = \sum_{n,i} W_n f_{n,i}(n)$$

wherein $f_{n,i}(n)$ is a functional correlation of the nth parameter, i is an index designating the segment (10) and $W_n$ is a weighting factor for the functional correlation of the nth parameter.

8. The method according to claim 7, characterised in that for each found combination of segments (10) forming the reproduction sentence to be output as a message, an evaluation measurement (B) is calculated and from the found combinations of segments (10) those whose evaluation measurement (B) indicates that the segments (10), of the combination are composed according to a natural flow of speech are selected as the message to be reproduced.

9. Method according to claim 7, characterised in that the evaluation measurement (B) is calculated from the functional correlations $f_n(n)$ of at least the following parameters:

length (L) and position (P), as well as the front and rear transition value ($Ü_{vorn}$, $Ü_{hinten}$) of the segment (10) according to the following formula:

$$B = \sum_i \{W_L f_{Li}(L) + W_P f_{Pi}(P) + W_Ü f_{Üi}(Ü_{vorn}) + W_Ü f_{Üi}(Ü_{hinten})\}.$$

10. The method according to claim 1, characterised in that the reproduction sentence is in a format corresponding to the search criteria, wherein alphanumeric character strings are used for the search criteria and the transmitted reproduction sentences.

11. The method according to claim 1, characterised in that the search criteria are arranged hierarchically in a database (11).

12. The method according to claim 1, characterised in that for selection of the segments (10) for a message stored as audio files a test is done as to whether the reproduction sentence desired as a message coincides in its entirety with a search criterion filed in a database (11) together with an allocated audio file, wherein, if this is not the case, the end of the respective reproduction sentence is reduced and then checked for consistencies with search criteria filed in the database (11) until one or more consistencies have been found for the remaining part of the reproduction sentence, said checking is continued for those parts of the reproduction sentence which were removed in a preceding step a check is done for each combination of segments (10) whose search criteria fully coincide with the reproduction sentence as to whether the segments (10) forming the reproduction sentence to be output as a message are composed according to their natural flow of speech and for the reproduction of a desired message the audio files of the segments (10) are used whose combination comes closest to the natural flow of speech.

* * * * *